US009387524B2

(12) United States Patent
Earp

(10) Patent No.: US 9,387,524 B2
(45) Date of Patent: Jul. 12, 2016

(54) EFFLUENT CONTAINMENT DEVICE FOR CLEANING FIN FAN COOLERS

(71) Applicant: The Blast Bag Company, Inc., La Porte, TX (US)

(72) Inventor: Danny Earp, La Porte, TX (US)

(73) Assignee: Danny Earp, La Porte, TX (US)

( * ) Notice: Subject to any disclaimer, the term of this patent is extended or adjusted under 35 U.S.C. 154(b) by 28 days.

(21) Appl. No.: 14/070,240

(22) Filed: Nov. 1, 2013

(65) Prior Publication Data

US 2015/0122355 A1 May 7, 2015

(51) Int. Cl.

| | |
|---|---|
| ***B08B 13/00*** | (2006.01) |
| ***B08B 3/02*** | (2006.01) |
| ***B08B 17/02*** | (2006.01) |
| ***B65D 88/16*** | (2006.01) |

(52) U.S. Cl.

CPC . *B08B 13/00* (2013.01); *B08B 3/02* (2013.01); *B08B 17/025* (2013.01); *B65D 88/1606* (2013.01); *Y10T 137/86067* (2015.04)

(58) Field of Classification Search

CPC ..... B65F 1/0006; B65F 2210/132; B08B 17/025; B65D 33/01; B65D 88/1618

USPC ..... 383/46, 44

See application file for complete search history.

(56) References Cited

U.S. PATENT DOCUMENTS

| | | | | |
|---|---|---|---|---|
| 4,622,027 | A | 11/1986 | Parish | |
| 4,707,969 | A * | 11/1987 | Marino | 53/449 |
| 4,919,546 | A * | 4/1990 | Imazeki et al. | 383/33 |
| 5,954,221 | A * | 9/1999 | Boland | 220/495.08 |
| 7,153,025 | B1 * | 12/2006 | Jackson et al. | 383/2 |
| 7,448,803 | B2 * | 11/2008 | Ootsubo | 383/100 |
| 2009/0232421 | A1 * | 9/2009 | Turvey | 383/44 |
| 2010/0322538 | A1 * | 12/2010 | Powell et al. | 383/16 |
| 2011/0056519 | A1 | 3/2011 | Card et al. | |
| 2013/0206251 | A1 | 8/2013 | Harr | |

FOREIGN PATENT DOCUMENTS

| | | |
|---|---|---|
| FR | 2 583 720 | 12/1986 |

* cited by examiner

*Primary Examiner* — Christopher Demeree
(74) *Attorney, Agent, or Firm* — Baker & Hostetler LLP

(57) ABSTRACT

An effluent container may include: a first sheet of material; a second sheet of material being attached to the first sheet of material so as to form a container, first and second liners are secured to the respective first and second sheets with securing sheets; at least one of either attaching structure located on the container configured to allow the container to be attached to a structure and closure structure located on the both the first and second sheets of material at the open end, the closure structure configured to allow the container to be closed onto a structure; and a drain located on one of the sheets at an end opposite the open end, the drain configured to provide selective fluid communication between the interior of the container and an outside of the container.

20 Claims, 4 Drawing Sheets

EFFLUENT CONTAINMENT DEVICE FOR CLEANING FIN FAN COOLERS

FIELD OF THE INVENTION

The present invention relates generally to an effluent container. More particularly, the present invention relates to a disposable bag configured to contain effluent generated during the cleaning of a fin fan cooler.

BACKGROUND OF THE INVENTION

From time to time coolers, such as fin fan coolers, are in need of cleaning. One way of cleaning a fin fan cooler is to flow cleaning fluid (which is often water) through the fin fan cooler. As the cleaning fluid moves through the fin fan cooler, the cleaning fluid may pick up contaminates from the cooler. The contaminates may have leaked from the cooler or may be present due to other sources. One tool that may be used in the cleaning process is a hydroblaster. The hydroblaster may discharge cleaning fluid through a fin fan cooler causing the cleaning fluid to flow through the fin fan cooler and out the other side of the cooler.

In view of current environmental concerns, it may be desirable to recapture the cleaning fluid once it has flowed through the fin fan cooler. Recapture of the cleaning fluid may be desirable because the cleaning fluid itself may need proper disposal or that the cleaning fluid, once it has been contaminated by being flushed through the cooler becomes an effluent that now contains contaminates that need to be properly disposed of.

Further, it is possible that a fin fan cooler may leak causing an effluent to flow out of the cooler.

Accordingly, it is desirable to provide an apparatus that allows an effluent flowing out of a structure such as a fin fan cooler to captured for proper disposal.

SUMMARY OF THE INVENTION

The foregoing needs are met, to a great extent, by the present invention, wherein in one aspect an apparatus is provided that in some embodiments provide an apparatus that allows an effluent flowing out of a structure such as a fin fan cooler to captured for proper disposal.

In accordance with one embodiment of the present invention, an effluent container is provided. The container may include: a first sheet of material having at least four sides; a second sheet of material also having at least four sides attached to the first sheet of material on at least three sides such that a fourth side of both the first and second sheets are not attached and form an open end to the container, the container having an interior; a first liner attached to the first sheet of material; a second liner attached to the second sheet of material; closure structure located on the fourth side of both the first and second sheets and configured to allow the container to be closed onto a structure; attaching structure attached to the fourth side of both the first and second sheets and configured to provide attaching points for attaching the container to a structure; and a drain located on one of the sheets at an end opposite the open end, the drain configured to provide selective fluid communication between the interior of the container and an outside of the container.

In accordance with another embodiment of the present invention, an effluent container may be provided. The container may include: a first sheet of material having at least four sides; a second sheet of material also having at least four sides attached to the first sheet of material on at least three sides such that a fourth side of both the first and second sheets are not attached and form an open end to the container the container having an interior; a first liner attached to the first sheet of material; a second liner attached to the second sheet of material; a closure structure located on the fourth side of both the first and second sheets and configured to allow the container to be closed onto a structure, wherein the closure structure is a strap that can be shortened to attach the container to a structure; and a drain located on one of the sheets at an end opposite the open end, the drain configured to provide selective fluid communication between the interior of the container and an outside of the container.

In accordance with yet another embodiment of the present invention, an effluent container is provided. The container may include: a first sheet of material; a second sheet of material having a corresponding shape to the first sheet of material, the first sheet and second sheet of material being attached to each other around the perimeter of the first and second sheets so as to form a container having an open end, such that the container has an interior; a first liner attached to the first sheet of material; a second liner attached to the second sheet of material, wherein the first and second liners are secured to the respective first and second sheets with securing sheets trapping the first and second liners between the securing sheet and the respective first and second sheets; at least one of either: attaching structure located on the container configured to allow the container to be attached to a structure and closure structure located on the both the first and second sheets of material at the open end, the closure structure configured to allow the container to be closed onto a structure; and a drain located on one of the sheets at an end opposite the open end, the drain configured to provide selective fluid communication between the interior of the container and an outside of the container.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
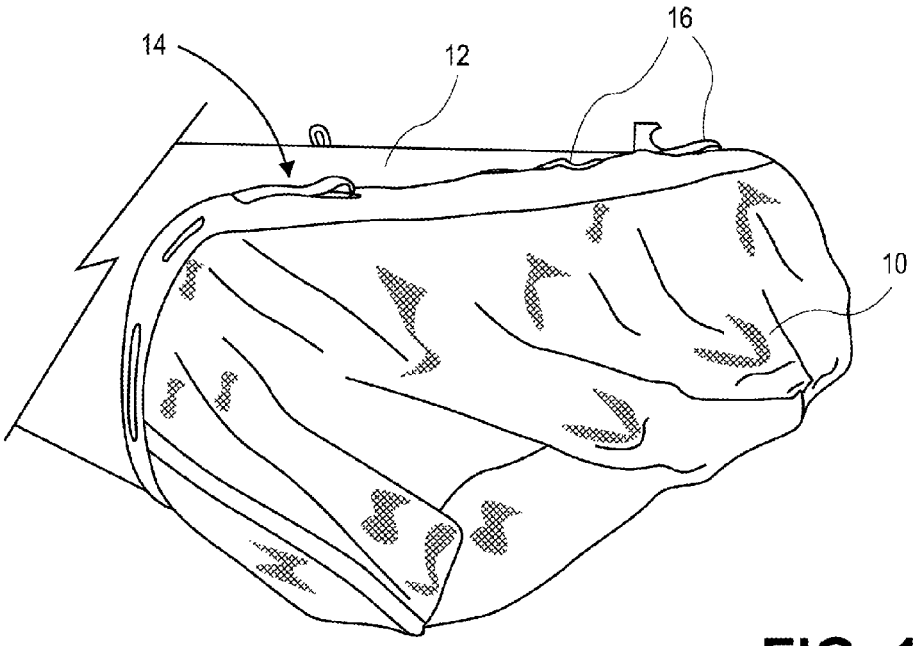
FIG. 1 is a perspective view illustrating a containment bag attached to a structure according to this disclosure.

The invention will now be described with reference to the drawing figures, in which like reference numerals refer to like parts throughout. An embodiment in accordance with the present invention provides a container that may be easily attached to a structure that may be a source of an effluent. The container will allow the effluent to be recaptured for proper recycling, reclamation, or disposal. In some embodiments, the container will be inexpensive and easy to dispose of so that the container itself does not require cleaning or create a problem for disposal.

FIG. 1 is a perspective view of a container 10 in accordance with the present disclosure. The container 10 is attached to a source 12. The source 12 is a structure upon which the container 10 is attached. The source 12 may contain or be a fin fan cooler. At side opposite of the source 12, (not shown) a hydroblaster may be cleaning the fin fan cooler causing a cleaning fluid to flow through the fin fan cooler. The cleaning fluid may pick up contaminants in the fin fan cooler creating an effluent. The effluent is captured by the container 10 when the effluent flows out of the fin fan cooler.

The hydroblaster is used to perform hydroblasting operations using a hydroblasting fluid under extreme pressure, which may include a blast of water, with an added abrasive, to remove grime or other deposits from the interior of the source 12. The fluid and debris may also consist of hazardous materials. During a hydroblasting operation, the hydroblaster may be used to spray the fluid at a working pressure within the range of 10,000 PSI and 40,000 PSI.

The container 10 has an open end 14. The open end 14 exposes the interior 15 of the container 10. The container 10 is secured to the source 12 by closing structure 16 such as straps 16. Although straps 16 are illustrated in the accompanying figures, other closing structure 16 may be used in accordance of the present disclosure. Closing structure 16 that may be used in accordance with the present disclosure may gather the open end 14 around the source 12 so as to close gaps between the container 10, and the source 12 and secure the container 10 to the structure defining the source 12.

Figure 2:
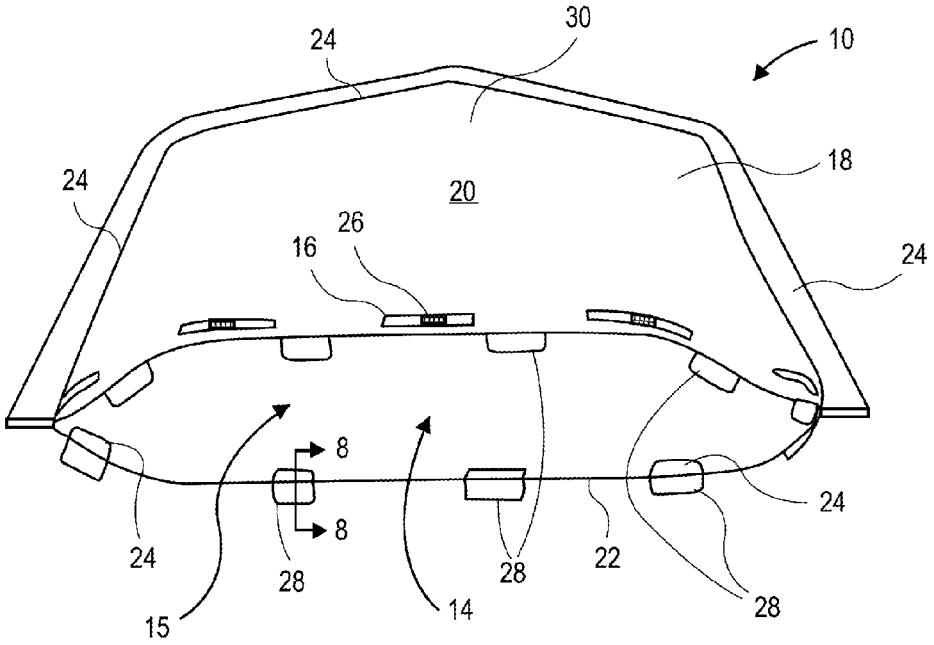
FIG. 2 is a front, perspective view of a containment bag in accordance with this disclosure.

FIG. 2 is a perspective top and front end view of the container 10. The container 10 is made primarily of material 18. The material 18 may be polyethylene in a sheet form. In some embodiments, the polyethylene is low density polyethylene (LDPE) and may be reinforced with fibers such as, for example, but not limited to, nylon. Several layers of material 18 are used in the construction of the container 10. For example, as shown in FIG. 2, a top sheet of material 20 is located above the bottom sheet of material 22. The top material 20 and the bottom material 22 are connected at seams 24. In some embodiments, the seams 24 are located around the outer edges of the top material 20 and the bottom material 22 with the exception of one edge. This one edge where the top material 20 is not connected to the bottom material 22 defines the open end 14.

In some embodiments, the top material 20 and the bottom material 22 may be constructed in a multiple plies. In other words, the top material 20 may be actually two or more sheets. In some embodiments, the top material 20 and the bottom material 22 are two ply sheets. The top material 20 and the bottom material 22 may be attached in a variety of ways to form the seams 24. For example, the seams 24 may be formed by sewing, heat welding, sonic welding, impulse welding, epoxies, adhesives, or any other suitable way of attaching sheets together.

The straps 16 may be equipped with multiple buckles 26 as shown. The buckles 26 may assist a user in tightening the open end 14 around a source or other structure 12 to which it is desired to attach the container 10.

In some embodiments, the open end 14 of the container 10 may be equipped with attaching structure 28. In the embodiment shown in the figures, the attaching structure 28 may be in the form of loops 28. The loops 28 may be made of the material folded back over itself and attached to the container 10 at various seams 24. The attaching structure 28 may provide another way for the container 10 to be attached to a structure 12 or otherwise provide a structure to move or secure the container 10.

In addition to having an open end 14, the container 10 has a closed end 30. The closed end 30 is surrounded by the seams 24. In some embodiments, the container 10 may have a generally rectangular shape, however, as shown in FIG. 2, the closed end 30 may be formed of two seams 24 that are at an obtuse angle to each other. In instances where the container 10 is rectangular in shape, the container 10 may have three long seams 24 which attach the top material 20 to the bottom material 22. In embodiments having more than four sides, as shown in FIG. 2, there will generally be more than three seams 24 attach the top material 22 the bottom material 22.

Figure 3:
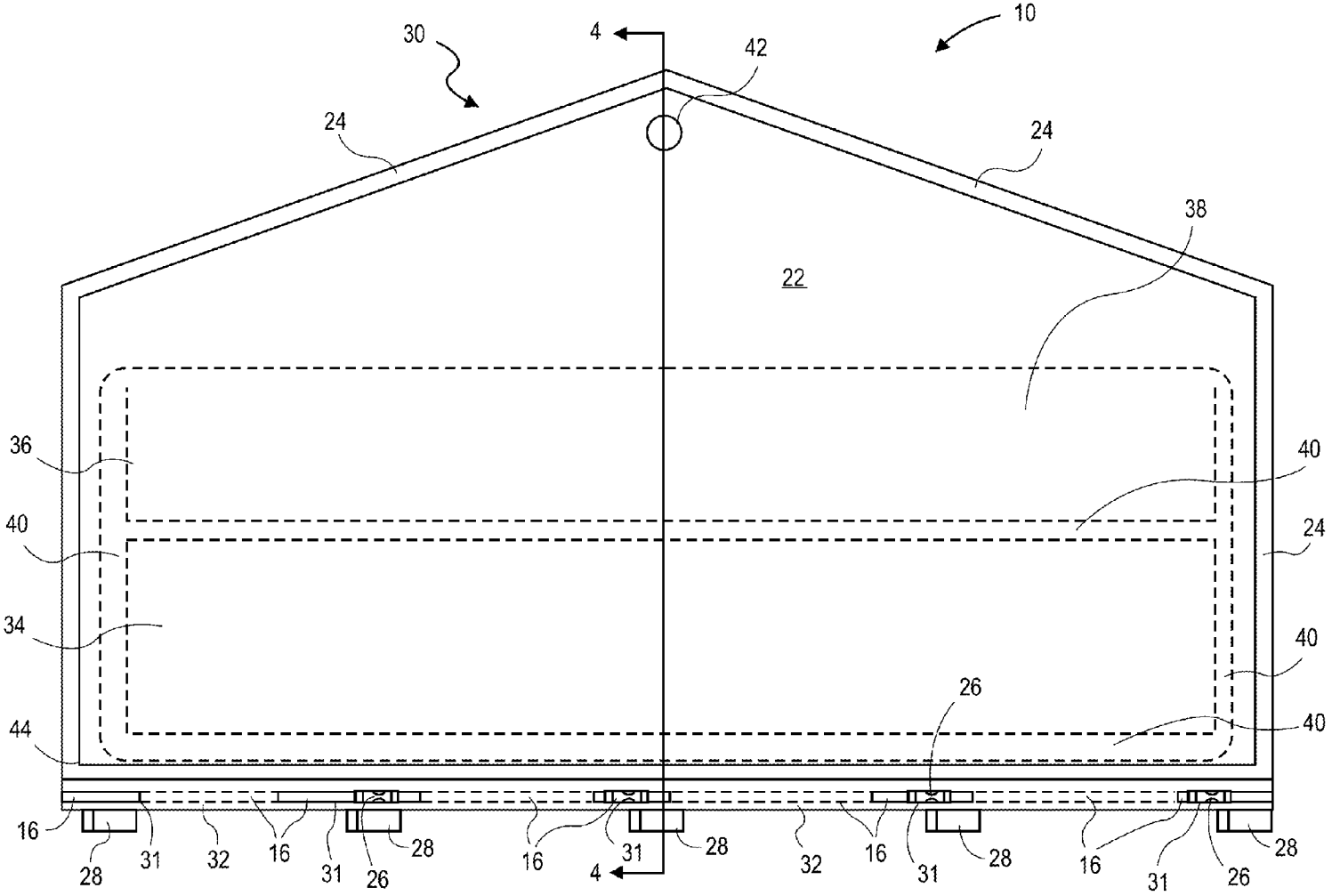
FIG. 3 is a bottom view of a containment bag in accordance with this disclosure.

FIG. 3 is a bottom view of the container 10 in accordance with an embodiment of this disclosure. The bottom material 22 or sheet 22 is seen attached by various seams 24 to the top material 20 or sheet 20 (not shown in FIG. 3 but is a readily seen in FIG. 2). The straps 16 along with the buckles 26 are readily visible. The straps 16 may be attached to each other serially to form a single long strap or belt. The strap 16 may reside in a strap loop 32. The strap loop 32 may be comprised of the material 18 folded back on itself to form a loop and is attached to the container 10 by a seam 24. The strap loop 32 may have various breaks or openings 31 or windows 31 in order to allow a user access to the strap 16 and, in some embodiments, the buckles 26.

Portions of the strap 16 and the buckles 26 are illustrated in FIG. 3 to reside in the strap loop windows 31. The portions of the strap 16 that are located in the strap loop 32 are shown in broken lines FIG. 3.

FIG. 3 illustrates a liner 34 in broken lines. In some embodiments, the liner 34 is made of high density polyethylene (HDPE). The liner 34 helps to reinforce the container 10. In some embodiments, the liner 34 is located in the interior 15 of the container 10. The liner 34 may be attached to top material 20 and the bottom material 22 shown in FIG. 3.

In some embodiments, the liner 34 is attached to top material 24 the bottom material 22 by a retaining flap 36. The retaining flap 36 may be made of the same material 18 as the top material 20 or sheet 20 and the bottom material 22 or sheet 22. The retaining material or flap 36 may extend beyond the liner 34 toward the closed end 30 to form a loose end 38 as shown. The retaining flap 36 may be attached to the top material 24 the bottom material 22 by retaining seams 40.

The container 10 is equipped with a drain 42. The drain 42 is useful in allowing effluent accumulating in the container 10 be drained into an appropriate container or disposal system. In the embodiment shown in FIG. 3, the drain 42 is located in the bottom sheet 22 at the closed end 30 near a junction between two seams 24 that form an obtuse angle.

Figure 4:
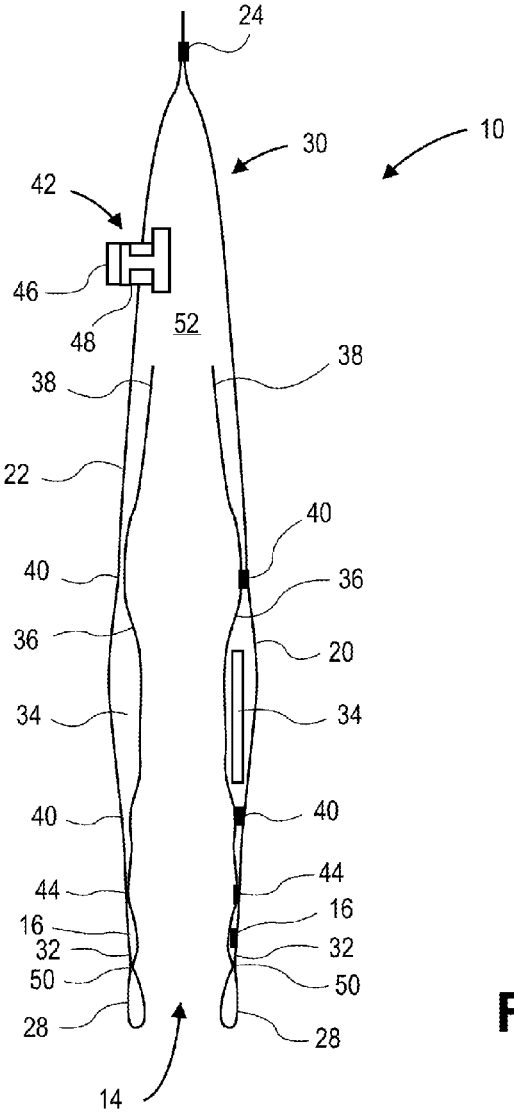
FIG. 4 is a cross-sectional view taken along the lines 4-4 in FIG. 3.

FIG. 4 is a cross-sectional view of the container 10 shown in FIG. 3. Starting toward the top of FIG. 4, the seam 24 at the closed end 30 connecting the top material 20 and the bottom material 22 is shown. The drain 42 located in the bottom sheet 22 is illustrated. Both the cap 46 and the spigot 48 are shown. In some embodiments, the cap 46 attaches to the spigot 48 by threads. If needed, a gasket may be used to help seal the cap 46 to the spigot 48. When the container 10 is in use, the cap 46 may be removed and replaced by a hose or other conduit.

The loose ends 38 for each of the retained flaps 36 can be seen. The loose ends 38 may provide reinforcement to the container 10. The retaining flaps 36 are attached by retaining seams 40 located both before and after the liner 34 thereby trapping the liner 34 between the retaining seams 40, the retaining flaps 36 and the top 20 and bottom 22 sheets.

The strap loop retaining seams 44 are shown attaching strap loop 32 to the container 10. The strap 16 residing in the strap loop 32 is also shown. The strap loop retaining seams 44 are formed of material 18 folded back on itself. The loops 28 are also shown. The loops 28 are formed of material 18 looped back on itself, and attached to the container 10 by retaining seam 50.

Figure 5:
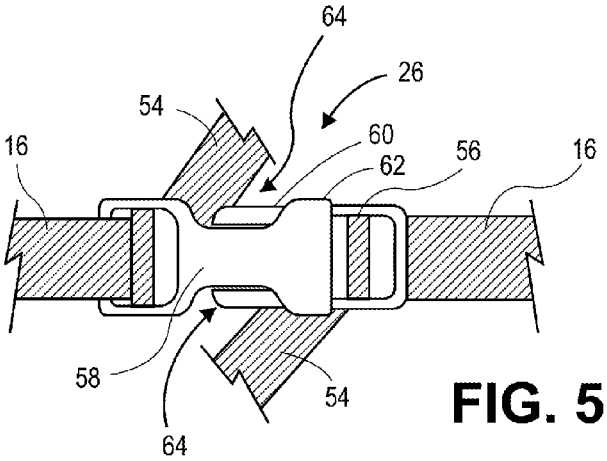
FIG. 5 is a top view of one example of a latched buckle that may be used in accordance with this disclosure.
Figure 6:
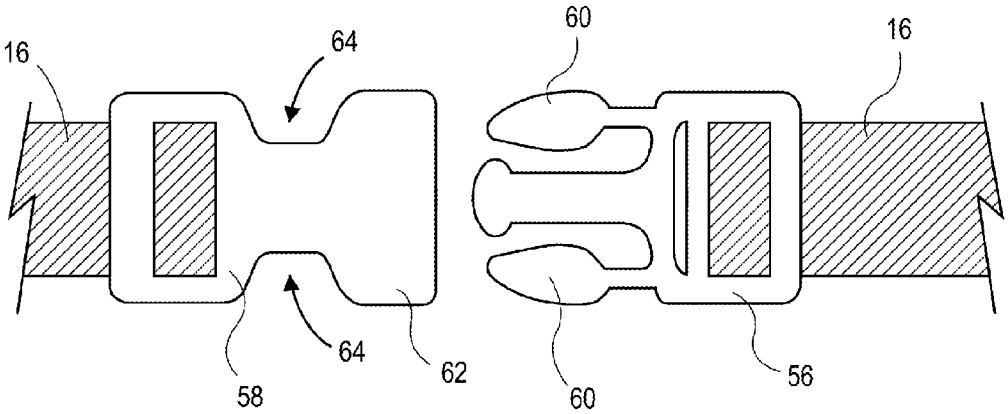
FIG. 6 is a top view of a non-latched buckle that may be used in accordance with this disclosure.

FIG. 5 is a top view of a buckle 26 in a closed position in accordance with an embodiment. FIG. 6 is a top view of the buckle 26 in an open position. With reference to both FIGS. 5 and 6, the straps 16 are shown attached to the buckle 26 and the strap ends 54 are shown. In some embodiments, the strap 16 may be tightened by pulling on the strap ends 54. The buckle 26 may be of a common snapping type buckle 26. The buckle 26 may include an interior buckle 56 that fits with an exterior buckle 58 to snap in place. The interior buckle 56 may include flexing fingers 60 that are compressed together when entering the compression end of the exterior buckle 58.

Once the flex fingers 60 have moved beyond the compressing end 62 to the locking cutouts 64, the flex fingers 60 may move outwardly thereby locking the interior buckle 56 to the exterior buckle 58. To unlock and remove the interior buckle 56 from the exterior buckle 58, a user may compress the flex fingers 60 towards each other, and then simply slide the interior buckle 56 out of the exterior buckle 58 as shown in FIG. 6. The particular buckles 26 shown are meant to be examples only. Other types of buckles or fasteners may be used in accordance with this disclosure.

Figure 7:
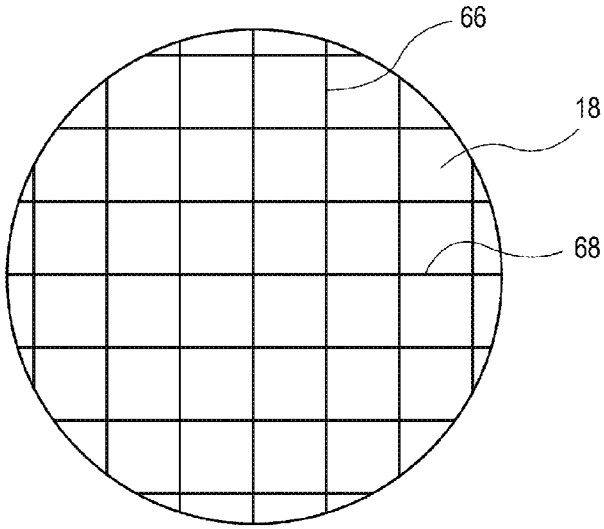
FIG. 7 is a top view of a sample of the fabric that may be used in the containment bag in accordance with this disclosure.

FIG. 7 is a close-up view of the material 18 out of which various portions of the container 10 may be made. In some embodiments, the material 18 is used to form the top sheet 20 the bottom sheet 22, strap loop 52, the retaining lap 36, and the strap loop 32. Other features may also be formed of the material 18. In the embodiment shown in the figures, the material 18 is formed of low density polyethylene (LDPE) reinforced by nylon fibers 66 and 68. Fibers 66 run in a longitudinal direction and fibers 68 run in a latitudinal direction thereby forming a grid-like structure. In some embodiments, the longitudinal fibers 66 may be interwoven with the latitudinal fibers 68.

In some embodiments, the fabric 18 may be translucent or even transparent. These features will allow a user to monitor the amount of effluent contained within the container 10. In some embodiments, symbols, logos, trademarks or other writing such as instructions or other useful information may be printed on the material 18. As mentioned above, some embodiments the material 18 made of multiple plies. In some embodiments the material 18 may withstand temperatures up to 172° F.

The container 10 may be constructed of material 18 configured to withstand fluid pressured between 10,000 PSI and 40,000 PSI. Fluids at such pressure may originate from a hydroblaster. The container 10 may come in a variety of sizes such as 4, 6, 8, 10, 12, 14, 16, 18, 20 foot lengths and 12, 18 and 30 inch widths. Other sizes larger, smaller and in between those mentioned may also be used.

Figure 8:
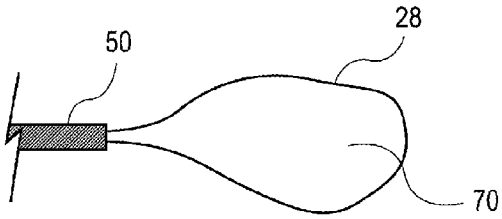
FIG. 8 is a cross-sectional view taken along the line 8-8 in FIG. 2.

FIG. 8 illustrates a cross-sectional view of the loops 28. The loops 28 may be useful in securing or moving the container 10 with respect to the structure 12 (as shown in FIG. 2). The loops 28 may be made of the material 18 folded back on itself trapping an interior portion 70. The loops 28 may be attached to the container 10 by the loop retaining seam 50.

Although an example of the container 10 is shown being used with a fin fan cooler, it will be appreciated that container 10 may be used with other structures that may have effluent flowing out. The fin fan cooler is merely a non-limiting example of a structure for which the container 10 of this disclosure may be useful.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An effluent container comprising:

a first sheet of material having at least four sides;

a second sheet of material also having at least four sides attached to the first sheet of material on at least three sides such that a fourth side of both the first and second sheets are not attached and form an open end to the container, the container having an interior and a single opening at the open end, the opening being adapted for encompassing an open end of a structure, such that the container is adapted for receiving effluent from the open end of the structure in a hydroblasting operation;

a first liner attached to the first sheet of material;

a second liner attached to the second sheet of material;

a strap located on the fourth side of both the first and second sheets and configured to allow the container to be closed onto the structure; and a drain located on one of the sheets at an end opposite the open end, the drain configured to provide selective fluid communication between the interior of the container and an outside of the container.

2. The effluent container of claim 1, wherein the first and second sheets have at least a two ply construction.

3. The effluent container of claim 1, wherein the first and second liners are secured to the respective first and second sheets with securing sheets trapping the first and second liners between the securing sheet and the respective first and second sheets.

4. The effluent container of claim 3, wherein the liner is made of high density polyethylene (HDPE).

5. The effluent container of claim 3, wherein the securing sheets extend beyond the liner to form a free end opposite the open end of the container.

6. The effluent container of claim 1, wherein the sheets are attached to each other at seams, wherein the seams are formed by, one of any of the following: heat welding, chemical welding, an adhesive, sewing, impulse welding and sonic welding.

7. The effluent container of claim 1, wherein the strap includes at least two buckles located on the strap in series.

8. The effluent container of claim 7, wherein the strap is attached to the container by being trapped in a folded over portion of the first and second sheets.

9. The effluent container of claim 1, wherein the strap is configured to be tightened to close the container onto the structure, the strap includes at least two buckles located on the strap in series and portions of the strap having buckles extending through openings in the folded over portions to allow access to the buckles.

10. The effluent container of claim 1, wherein the drain is located proximate to where seams connecting the first and second sheet form an obtuse angle.

11. The effluent container of claim 1, wherein the open end defines a width and the container is wider than it is long.

12. The effluent container of claim 1, wherein the first and second sheets define five sides and the first and second sheet are attached to each other along four of the sides.

13. The container of claim 1, further comprising an attaching structure attached to the fourth side of both the first and second sheets and configured to provide attaching points for attaching the container to the structure.

14. The effluent container of claim 13, wherein the attaching structure includes looped material made of the same material as the first and second sheets.

15. The effluent container of claim 14, wherein the material made of polyethylene reinforced with nylon, wherein the nylon is in the form of fibers imbedded in the polyethylene in a grid pattern.

16. An effluent container comprising:

a first sheet of material having at least four sides;

a second sheet of material also having at least four sides attached to the first sheet of material on at least three sides such that a fourth side of both the first and second sheets are not attached and form an open end to the container, the container having an interior and one and only one opening at the open end such that the container is adapted for mounting on a fin fan cooler for receiving effluent from a hydroblasting operation thereof;

a first liner attached to the first sheet of material;

a second liner attached to the second sheet of material;

a strap located on the fourth side of both the first and second sheets and configured to allow the container to be closed onto the fin fan cooler, wherein the strap can be shortened to attach the container to the fin fan cooler, wherein the strap is adapted for reducing a dimension of the one and only one opening upon mounting the container on the fin fan cooler and shortening the strap; and a drain located on one of the sheets at an end opposite the open end, the drain configured to provide selective fluid communication between the interior of the container and an outside of the container.

17. An effluent container comprising:

a first sheet assembly including a first sheet of material and a first liner;

a second sheet assembly including a second sheet of material and a second liner, the second sheet assembly having a corresponding shape to the first sheet assembly, the first sheet and the second sheet assemblies being attached to each other around the perimeter of the first and second sheet assemblies so as to form a container having an open end, such that the container has an interior and an opening at the open end such that the container is adapted for mounting on a fin fan cooler for receiving effluent from a hydroblasting operation thereof;

the first and second liners are secured to the respective first and second sheets;

at least one of either: attaching structure located on the container configured to allow the container to be attached to the fin fan cooler and straps located on the both the first and second sheets of material at the open end, the straps configured to allow the container to be closed onto the fin fan cooler; and a drain located on one of the sheets at an end opposite the open end, the drain configured to provide selective fluid communication between the interior of the container and an outside of the container.

18. The container of claim 17, further comprising securing sheets trapping the first and second liners between the securing sheet and the respective first and second sheets.

19. The container of claim 17, wherein the opening is a single opening.

20. The container of claim 17, wherein the strap is adapted for reducing a dimension of the opening upon mounting the container on the fin fan cooler and shortening the strap.

* * * * *